US005988793A

United States Patent [19]

Hattori

[11] Patent Number: 5,988,793

[45] Date of Patent: Nov. 23, 1999

[54] PIEZOELECTRIC ELECTRODE APERTURE PLATE FOR AN IMAGE FORMING DEVICE

[75] Inventor: Tomoaki Hattori, Nagoya, Japan

[73] Assignee: Brother Kogyo Kabushiki Kaisha, Nagoya, Japan

[21] Appl. No.: 08/483,968

[22] Filed: Jun. 7, 1995

[30] Foreign Application Priority Data

Jun. 9, 1994 [JP] Japan ..... 6-127259

[51] Int. Cl.[6] ..... B41J 2/06

[52] U.S. Cl. ..... 347/55

[58] Field of Search ..... 347/55, 147, 68, 347/112, 141, 151

[56] References Cited

U.S. PATENT DOCUMENTS

| | | | |
|---|---|---|---|
| 4,340,835 | 7/1982 | Nakamura et al. | 310/321 |
| 4,994,703 | 2/1991 | Oguri et al. | 310/363 |
| 5,233,392 | 8/1993 | Kitamura | 347/55 X |
| 5,428,382 | 6/1995 | Shimosato et al. | 347/71 |

FOREIGN PATENT DOCUMENTS

| | | | |
|---|---|---|---|
| 587 366 A1 | 3/1994 | European Pat. Off. | 347/55 |
| 62-50849 | 3/1987 | Japan | 347/55 |
| 1-65820 | 3/1989 | Japan . | |
| 63-72557 | 4/1989 | Japan . | |
| 6-143660 | 5/1994 | Japan | 347/55 |

OTHER PUBLICATIONS

Richard J. Lewis, Jr. *Hawley's Condensed Chemical Dictionary*, 12th Edition Van Nostrand Reinhold Company, N.Y., 1993, p. 387.

Zaitsev, V.N. and Morozov, E.M. and Andrianov, E.G., "Effect of Gamma Radiation on Piezomaterials Plasticized by Polymers", Neorg. Mater., 1979, vol. 15, pp. 2089–2091.

*Primary Examiner*—N. Le
*Assistant Examiner*—D. Dickens
*Attorney, Agent, or Firm*—Oliff & Berridge, PLC

[57] ABSTRACT

A piezoelectric body formed onto one surface of an insulation sheet of an aperture electrode, the piezoelectric body being in direct confrontation with a toner-bearing roller. The piezoelectric body is formed of a mixture of a binder and piezoelectric material particles provided by pulverizing a piezoelectric material mass. A plurality of apertures are formed through the insulation sheet and the piezoelectric body, and control electrodes are provided around each aperture. The piezoelectric body is deformable upon generation of an electrical field. In a first deformation of the piezoelectric body, the thickness of the piezoelectric body is increased to provide a dam at a downstream portion of the aperture, which facilitate the toner orientation toward the aperture.

12 Claims, 3 Drawing Sheets

PIEZOELECTRIC ELECTRODE APERTURE PLATE FOR AN IMAGE FORMING DEVICE

BACKGROUND OF THE INVENTION

The present invention relates to a piezoelectric element and an image forming device using the piezoelectric element.

In a conventional image forming device such as a copying machine, a printer and a facsimile, etc., there are provided an electrode aperture plate, a toner bearing roller and a back electrode. The electrode aperture plate is disposed between the toner bearing roller and the back electrode.

The toner-bearing roller is rotatably disposed separated from the electrode aperture plate by a gap through which an image forming medium is transported. The aperture electrode plate includes an insulation base, through which are formed a plurality of linearly aligned apertures, and control electrodes formed around the apertures to the surface of the insulation base. The back electrode roller is rotatably disposed adjacent to the aperture electrode plate and is for supplying toner particles to the aperture electrode plate. The image forming device also includes a control circuit for controlling application of voltage to the control electrodes based on image formation data.

Electric fields are selectively generated by applying a voltage to the control electrodes formed around apertures in the electric aperture plate. Charged toner supplied on the toner-bearing roller is drawn into apertures of energized control electrodes and then further attracted by the back electrode so as to impinge the toners onto a recording sheet passing between the aperture electrode plate and the back electrode.

SUMMARY OF THE INVENTION

Through inhouse R & D activities, a proposal is made with respect to the separation of the toner from the toner-bearing roller to facilitate toner travel to the image recording medium. According to this proposal, an image forming device further includes a piezoelectric sliding-contact body formed from a lead zirconate titanate (PZT) or other type piezoelectric element. The piezoelectric sliding-contact body is disposed adjacent to and at a position upstream of (in regards to the rotation direction of the toner-bearing roller), the apertures of the aperture electrode plate. The piezoelectric sliding body contacts and slides along the surface of the rotating toner-bearing roller only when the image forming operation is performed, that is only when the toner travel from the toner-bearing roller to the image recording medium is intended. When the piezoelectric sliding body contacts the toner-bearing roller, the piezoelectric sliding body scrapes toner off the surface of the toner-bearing roller, so that even strongly clinging toner will be sent attracted toward the back roller using only a small drive voltage.

However with this image forming device, only a small gap of several tens of micron meters separates the aperture electrode plate and the toner-bearing roller. Piezoelectric elements with the desired piezoelectric properties could be formed into a single crystal by sintering the basic material (such as PZT) at a high temperature. However, producing a piezoelectric element less than 100 micrometers thick is very costly. Additionally, stable contact between a rigid PZT piezoelectric element and the toner-bearing member is difficult to obtain. Also, an aperture of only 100 micrometers diameter is difficult to form into the rigid PZT piezoelectric element.

Therefore, it is an object of the present invention to overcome the above-described problems and provide a piezoelectric body that can be formed into a thin film and provide an image forming device using this piezoelectric body that can form images at desired image density, contrast, and print speed.

These and other objects of the present invention will be attained by providing a piezoelectric body comprising piezoelectric material particles provided by pulverizing a piezoelectric material mass, and a binder mixed with the pulverized piezoelectric material particles.

In another aspect of the invention, there is provided a method of forming an aperture electrode body which selectively allow toners to pass therethrough for forming a toner image on an image recording medium, the method comprising the steps of preparing an insulation base printed with control electrodes, preparing a sintered piezoelectric material mass, pulverizing the sintered piezoelectric material mass into piezoelectric material particles, mixing the piezoelectric material particles with a binder to provide a piezoelectric material mixture, forming the mixture over the insulation base, curing the piezoelectric material mixture to provide a cured body on the insulation base, polarizing the cured body to provide a piezoelectric body on the insulation base, and forming apertures through the piezoelectric body and through the insulation sheet to provide a plurality of apertures.

In still another aspect of the invention, there is provided an image forming device for forming toner images on an image recording medium fed following a feed passage in a feeding direction, the image forming device including a toner-bearing body bearing toners, an insulation base, a plurality of control electrodes, a control circuit, and a piezoelectric body layer. The insulation base is disposed in confrontation with the toner-bearing body and has a plurality of apertures formed therethrough. The apertures have one end open to the toner bearing body and another open end open to the feed passage. The plurality of control electrodes are formed to the insulation base. One control electrode is formed around each aperture. The control circuit is connected to the control electrodes for selectively applying a voltage to control electrodes so as to control toner passage through the aperture. The piezoelectric body layer has a film shape and is provided to the insulation base at a side thereof confronting the toner-bearing body. The piezoelectric body layer includes piezoelectric material particles provided by pulverizing a piezoelectric material mass, and a binder mixed with the pulverized piezoelectric material particles.

DETAILED DESCRIPTION OF THE PREFERRED EMBODIMENTS

A piezoelectric element and an image forming device which uses the piezoelectric element according to a preferred embodiment of the present invention will be described while referring to the accompanying drawings.

Figure 1:
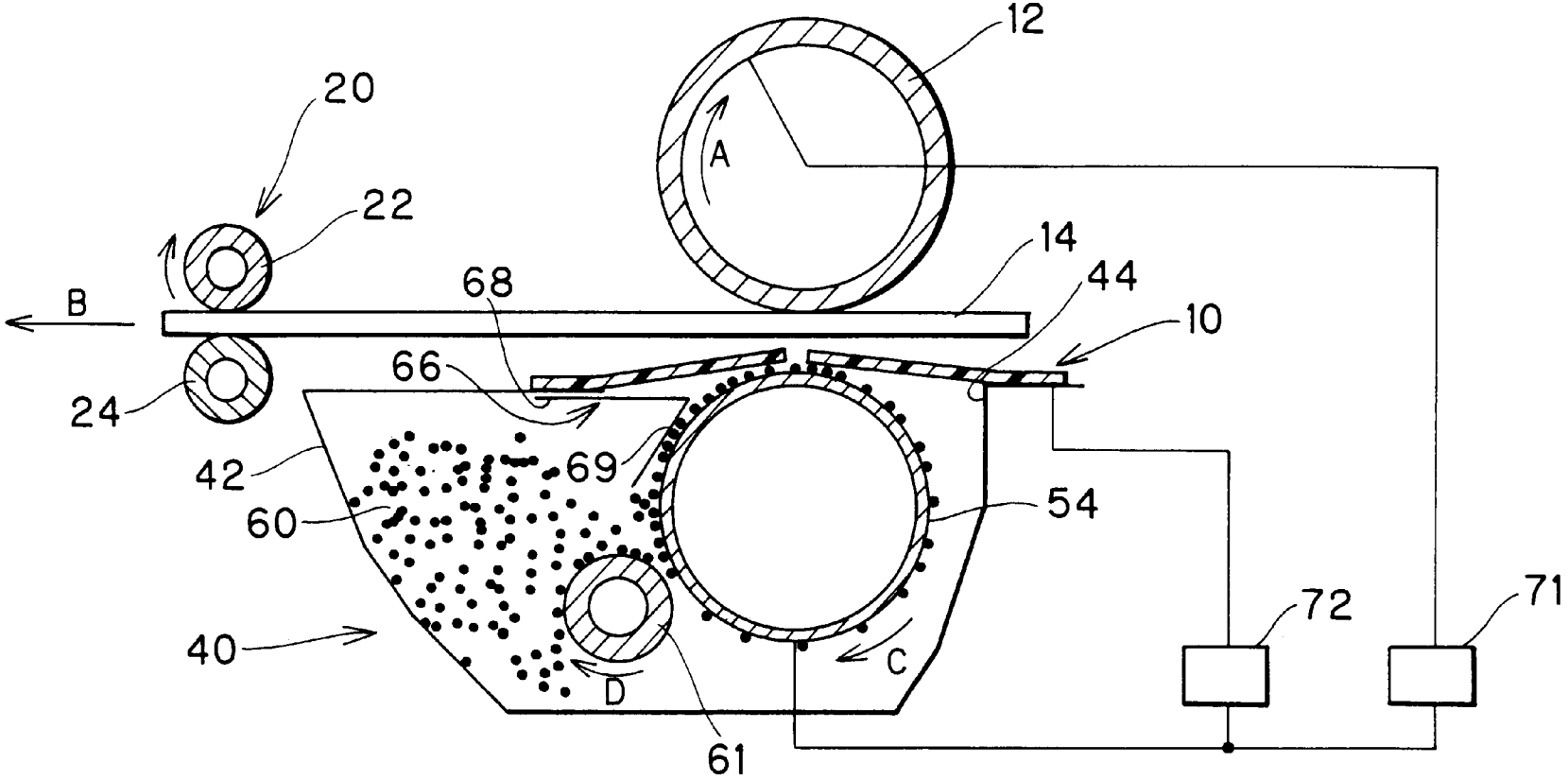
FIG. 1 is a cross-sectional view showing an image forming device according to an embodiment of the present invention.

As shown in FIG. 1, the image forming device includes a rotatable back electrode roller 12, an electrode aperture plate 10, and a toner supply unit 40. The electrode aperture plate 10 is attached to a toner case 42 of the toner supply unit 40 so as to be separated from the back electrode roller 12 by a distance of one millimeter.

The back electrode roller 12 is rotatably supported on a frame (not shown) and driven by a rotation drive unit (not shown) to rotate in the direction indicated by an arrow A. A sheet transporting unit (not shown) is provided to feed a recording sheet 14 between the electrode aperture plate 10 and the back electrode roller 12 in the sheet transport direction (indicated by an arrow B) while in contact with the back electrode roller 12. A fixing unit 20 is disposed in the transport path of the recording sheet 14 downstream (in the sheet transport direction B) from the back electrode roller 12 and toner supply unit 40. The fixing unit 20 includes a heat roller 22 and a support roller 24 for heating the recording sheet 14 and fixing toner images thereto.

Figure 2:
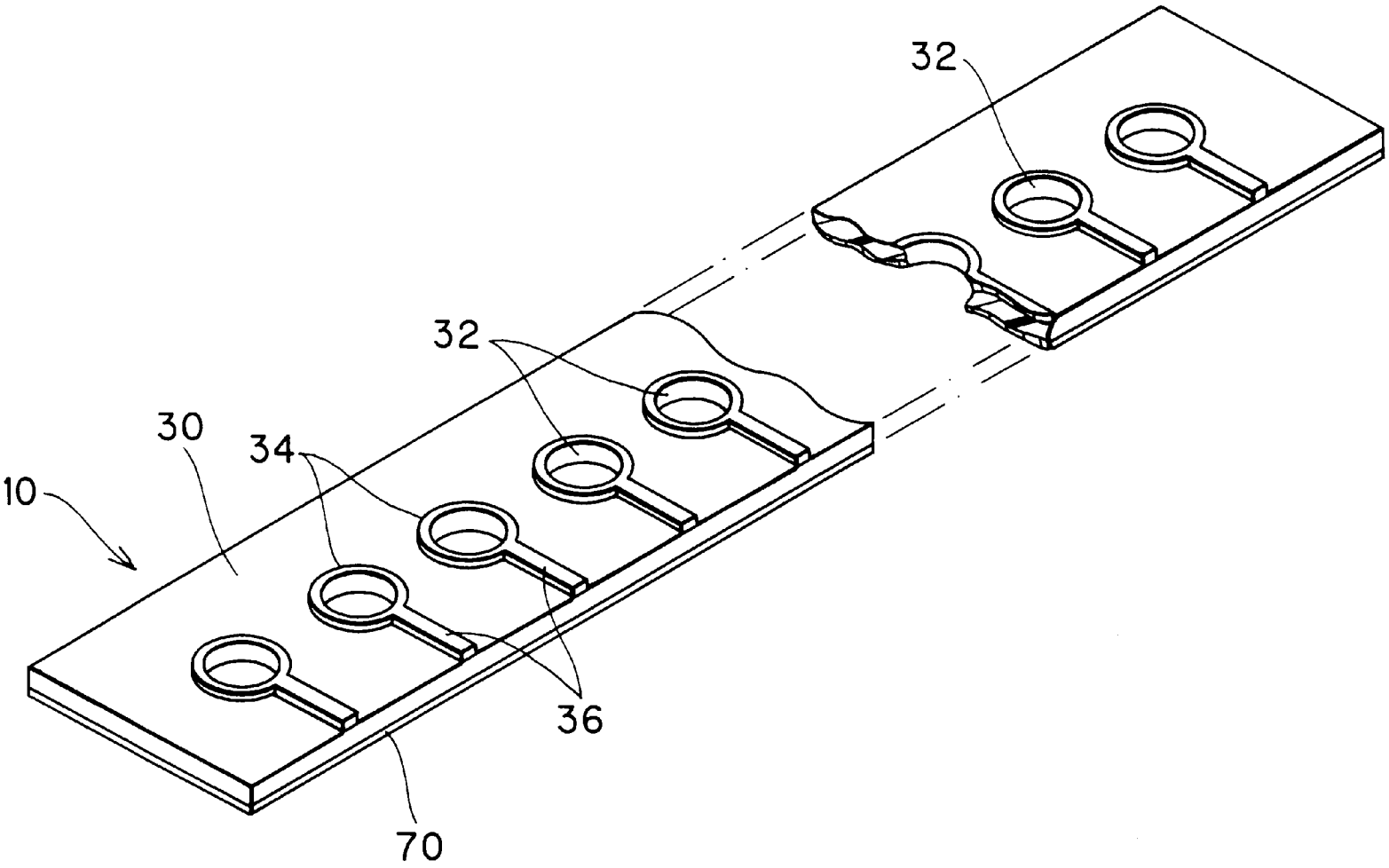
FIG. 2 is a perspective view showing an electrode aperture plate of the image forming device in FIG. 1.

As shown in FIG. 2, the electrode aperture plate 10 is an elongated web-like structure formed with a plurality of apertures 32 aligned along its length. The electrode aperture plate 10 includes two layers: an insulation sheet 30 and a piezoelectric body 70. Each aperture 32 is formed through the insulation sheet 30 and the piezoelectric body 70 to a diameter of 100 micrometers.

The insulation sheet 30 is formed from an approximately 25 micrometers thick layer of polyimide. A ring-shaped control electrode 34 is formed around each aperture 32 at the insulation sheet 30 side of the electrode aperture plate 10. The control electrodes 34 are formed to a thickness of one micrometer from a metal such as gold and copper. An individual lead 36 is connected to each control electrode 34. The insulation sheet 30 is described in this example as formed from a 25 micronmeters thick polyimide sheet because a thinner sheet would make attaching the control electrodes 34 difficult.

The piezoelectric body 70 is formed to a thickness of 5 micronmeters using screen printing techniques. The piezoelectric body 70 has been polarized by applying a positive 100 V voltage to the control electrode 34 and a 0 V voltage to the piezoelectric body 70 in a manner to be described in more detail later.

The toner case 42 is formed with an elongated opening 44 in its upper surface. The elongated opening extends perpendicular to the sheet transport direction B. The electrode aperture plate 10 is attached to the toner case 42 above the elongated opening 44 with the control electrodes 34 facing the back electrode roller 12 and aligned perpendicular to the sheet transport direction B.

A rotatable toner-bearing roller 54 serving as a toner-bearing electrode is supported in the toner case 42 with its axis of rotation aligned perpendicular to the sheet transport direction B. The toner-bearing roller 54 is formed from aluminum into a cylindrical shape. The toner-bearing roller 54 is attached to the toner case 42 so as to protrude slightly through the elongated opening 44 and press the electrode aperture plate 10 slightly upward. A rotation drive unit (not shown) is provided for rotating the toner-bearing roller 54 in the direction indicated by an arrow C.

A rotatable toner-supply roller 61 having almost the same length as the toner-bearing roller 54 is supported in the toner case 42 adjacent to and in contact with the toner-bearing roller 54. The toner-supply roller 61 is for supplying toner 60 to the toner-bearing roller 54. The toner 60 is accommodated in a portion of the toner case 42 downstream (in the sheet transport direction B) from the toner-bearing roller 54. A rotation drive unit (not shown) is provided for rotating the toner-supply roller 61 about its axis of rotation in the direction indicated by an arrow D, that is, in the same direction as rotation of the toner-bearing roller 54. Because the toner-bearing roller 54 and the toner-supply roller 61 rotate in the same direction, toner 60 clinging to the surface of the toner-supply roller 61 is scraped onto the toner-bearing roller 54 at the position where they contact.

A toner layer regulating blade 66 almost as long as the toner-bearing roller 54 is disposed in the toner case 42 at a position above the toner-supply roller 61. The toner layer regulating blade 66 is V-shaped in cross section, with one plate portion 68 fixed to the toner case 42 and another plate portion 69 extending tangentially alongside the toner-bearing roller 54 so as to resiliently press against the toner-bearing roller 54.

A power source 71 for supplying a positive 1 KV voltage to the back electrode roller 12 is electrically connected between the toner-bearing roller 54 and the back electrode roller 12. A voltage control application circuit 72 is connected between the control electrode 34 and the toner-bearing roller 54. The voltage control application circuit 72 is designed to selectively apply a positive 30 V voltage or a negative 30 V voltage to the control electrode 34 depending on image data.

Figure 3:
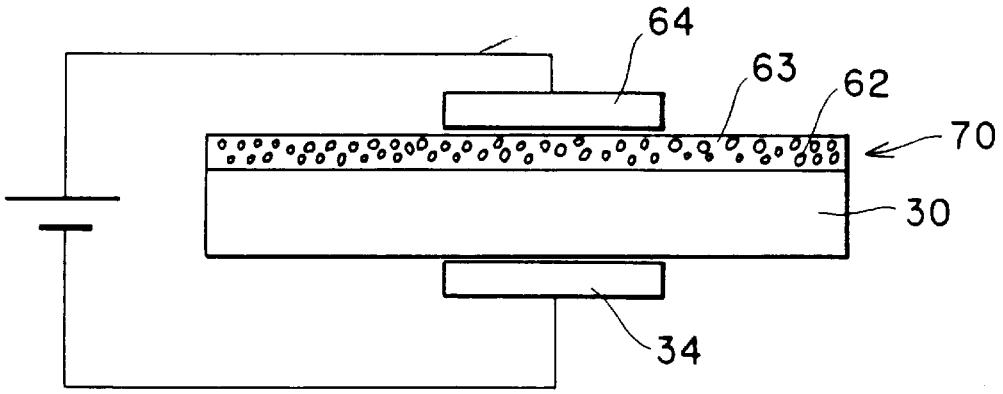
FIG. 3 is a cross-sectional view showing set up for polarizing a piezoelectric body of the electrode aperture plate.

Next, an explanation of a method for producing the piezoelectric body 70 will be provided while referring to FIG. 3. A piezoelectric element made from a barium titanate is sintered and formed to a barium titanate crystal plate. Using a pulverizer (not shown), the barium titanate crystal plate is pulverized into particles 62 with particle diameter of about one micronmeter. The particles 62 are mixed with liquid polyimide resin 63, which serves as a binder. The mixing weight ratio of the particles to the liquid polyimide resin 63 is 1:2.

The mixture of the liquid polyimide resin 63 and the particles 62 is printed, by a screen printing, into a five micronmeters thick film on an insulation sheet 30 having control electrodes 34 previously formed thereon. The liquid polyimide 63 on the insulation sheet 30 is then polymerized and hardened at an atmosphere of about 300° C. Since the piezoelectric material is pulverized into fine particles and since screen printing is performed to form the mixture of the particles and the binder over the insulation sheet 30, the resultant printed layer has relatively small thickness.

The particles 62 in the cured polyimide 63 are then polarized by attaching a polarization electrode 64 to the cured polyimide layer 63 which will contact the toner-bearing roller 54 and applying a 100 V DC voltage between the control electrode 34 and the polarization electrode 64 in an approximately 100° C. atmosphere. This polarizes particles 62 that are in the electric field so that polarized particles can function as the piezoelectric body layer 70. The resultant piezoelectric body layer 70 has a piezoelectric characteristic.

Next, the apertures 32 are formed through the insulation sheet 30 and the piezoelectric body layer 70 using laser beam. The apertures 32 can be easily opened in the piezoelectric body layer 70 because the piezoelectric body layer 70 has softness since it contains hardened liquid polyimide 63.

Next, an image forming process by the above-described image forming device will be described. When an image is to be formed on the recording sheet 14, the toner-supply roller 61 and the toner-bearing roller 54 are rotated in the direction indicated by arrows D and C as described above. A positive 1 KV voltage is applied to the back electrode roller 12. Toner 60 supplied on the toner-supply roller 61 is scraped onto the surface of the toner-bearing roller 54 by the mutual rotation of the toner-supply roller 61 and the toner-bearing roller 54. This scraping gives the toner 60 a negative charge. The plate portion 69 levels the toner 60 into an even layer on the surface of the toner-bearing roller 54 and also provides an even charge to the toner 60.

Further rotation of the toner-bearing roller 54 brings the layer of toner 60 on the toner-bearing roller 54 into confrontation with the electrode aperture plate 10. Control electrodes 34 of those apertures 32 through which toner 60 is to pass, as determined by image data, are energized with a 30V voltage. The bias produced between the energized control electrode 34 and the toner-bearing roller 54 creates an electric field near respective apertures 32.

Figure 4:
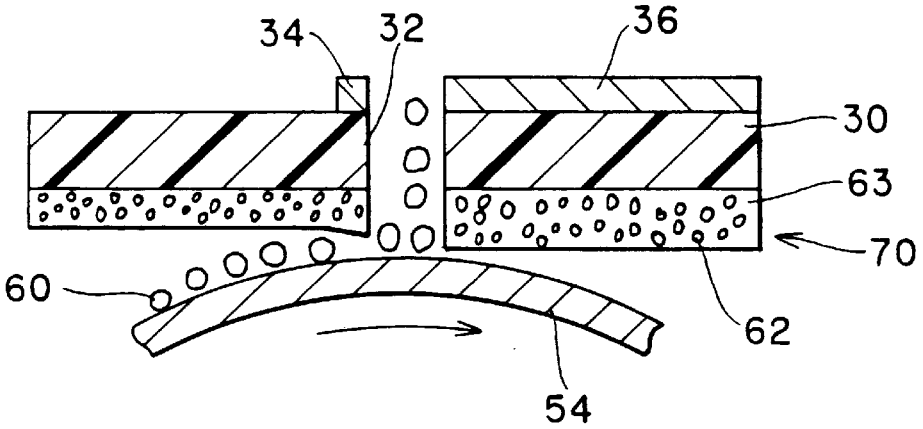
FIG. 4 is a cross-sectional view showing condition of the piezoelectric body when its corresponding lead is energized with a positive voltage.

In this case, as shown in FIG. 4, the electric field between an energized control electrode 34 and the toner-bearing roller 54 causes portions of the piezoelectric body 70 under energized control electrodes 34 to thicken. Portions of the piezoelectric body 70 under energizing leads 36 (that is, downstream in regards to the rotation of the toner-bearing roller 54) thickens more than the upstream portion of the piezoelectric body 70. This brings the lead-side portion of the piezoelectric body 70 into contact with the outer surface of the toner-bearing roller 54 so that the lead-side portion scrapes the toner particles 63 off the surface of the toner-bearing roller 54. The scraped off toner 60 is drawn toward the control electrode 34 by the electric force in direction of the high bias and flies into the aperture 32. Even though the toners 60 is fixedly held on the outer surface of the toner-bearing roller 54 by image force, the thickened portion of the piezoelectric body layer 70 can facilitate removal of the toners from the outer surface of the toner-bearing roller 54. In other words, upon application of voltage to the control electrode, the downstream piezoelectric body layer 70 is deformed to be thickened toward the toner-bearing roller 54. Thus, the toners are dammed up by the thickened portion, so that the dammed toners are easily directed toward the aperture as shown in FIG. 4.

As mentioned above, the back electrode roller 12 is energized with a positive 1 KV voltage. This produces an electric field between the back electrode roller 12 and the toner-bearing roller 54 strong enough pull toner 60 in the aperture 32 toward the back electrode roller 12. The toner 60 flies toward the back electrode roller 12 and impinges on and clings to the recording sheet 14 passing between the electrode aperture plate 10 and the back electrode roller 12.

Figure 5:
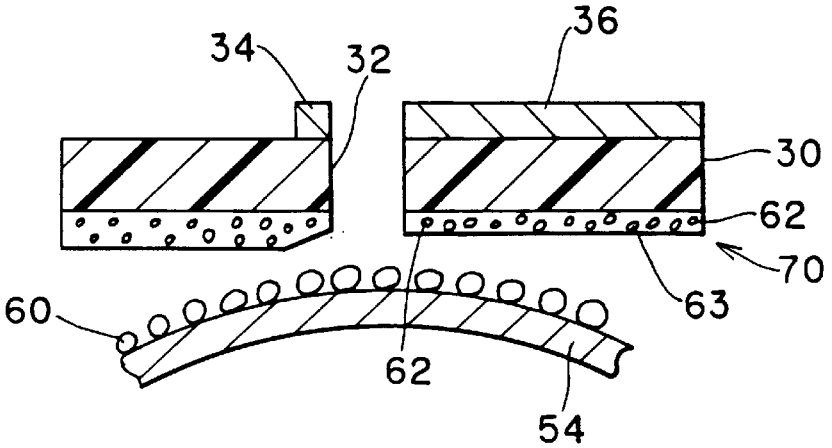
FIG. 5 is a cross-sectional view showing condition of the piezoelectric body when its corresponding lead is energized with a negative voltage.

On the other hand, a negative 30 V voltage is applied to the control electrodes 34 around those apertures 32 through which toner 60 is not to be passed. The resultant electric field between the toner-bearing roller 54 and the energized control electrode 34 has the opposite nature of the electric field formed by application of a positive 30 V voltage. The toner 60 on the toner-bearing roller 54 is not subjected to static electric force and so does not pass through the respective aperture 32. Additionally, as shown in FIG. 5, the electric field between the energized control electrode 34 and the toner-bearing roller 54 reduces the thickness of portions of the piezoelectric body 70 under negatively energized control electrodes 34. The thickness of the portion of the piezoelectric body 70 under the lead 36 (that is, downstream in regards to the rotation of the toner-bearing roller 54) reduces more than the upstream portion of the piezoelectric body 70. Therefore, the toner on the toner-bearing roller 54 will not enter or pass through the respective aperture 32, but will instead be returned to the toner case 42 by rotation of the toner-bearing roller 54.

A row of the apertures 32 provides one pixel line's worth of image. After one pixel line's worth of image is formed on the recording sheet 14, the recording sheet 14 is fed another pixel line's distance, in the direction perpendicular to the row of apertures. The control electrodes 34 are applied with voltages based on the next line's worth of image data, thereby forming the next pixel line's worth of image on the recording sheet 14. By repeating this process, the entire toner image is formed on the recording sheet 14. After the images for all image lines are completed, the toner image is fixed to the recording sheet 14 by the fixing unit 20. The recording sheet 14 with the fixed toner image formed thereon is then discharged from the image forming device.

According to the present embodiment, the recording sheet 14 serves as a image recording medium; the insulation sheet 30 serves as an insulating base; the toner-bearing roller 54 serves as a toner-bearing body; and the voltage control application circuit 72 serves as a control circuit.

While the invention has been described in detail with reference to specific embodiments thereof, it would be apparent to those skilled in the art that various changes and modifications may be made therein without departing from the spirit and scope of the invention. For example, the binder for the piezoelectric body 70 is not limited to liquid polyimide resin, but could be any curable material.

Further, the piezoelectric element is formed from barium titanate crystal plate in the embodiment, but could instead be formed from PZT, polyvinylidene fluoride, or any other material that shows piezoelectric properties.

Further, in the illustrated embodiment, screen printing is performed for forming the mixture of the liquid polyimide resin and the piezoelectric particles. However, other coating method such as spray-coating is also available. By coating the mixture of the piezoelectric material particles and the binder, resultant layer can be thin in a range of from 0.5 micronmeters to 300 micronmeters. Preferable coating thickness is in a range of from 10 to 20 micronmeters.

Furthermore, in the illustrated embodiment, the control electrodes are provided on the insulation sheet at a position opposite the piezoelectric body layer. However, control electrodes could be formed on the insulation sheet surface confronting the toner-bearing roller. The piezoelectric body could then be formed on the control electrodes so as to confront the toner-bearing roller. In other words, the control electrodes could be positioned between the insulation sheet and the piezoelectric body layer.

Furthermore, the piezoelectric body layer need not be provided at both upstream and downstream sides of the apertures in regards to the direction the toner-bearing roller 54 is rotated (direction of toner supply), but could be formed only on the downstream side.

The piezoelectric body layer of the present invention can be formed into a thin film having sufficient softness. Therefore, the piezoelectric body can be positioned at a minute space defined between the insulation base and the toner-bearing roller. Because the piezoelectric body layer is formed into a thin film on the side of the insulation base that faces the toner-bearing body, supply of toner into the aperture is facilitated when the piezoelectric body deforms under the electric field formed between the control electrode and the toner-bearing body. Therefore, only a low voltage is required to control the supply of toner and obtain the desired image density, print contrast, and print speed.

What is claimed is:

1. An image forming device for forming toner images on an image recording medium, the image forming device having a feed passage and a feeding direction for feeding the image recording medium, the image forming device further including:

a toner-bearing body bearing toner;

an insulation base disposed in confrontation with the toner-bearing body and having a plurality of apertures formed therethrough, each of the plurality of apertures having one end open to the toner-bearing body and another end open to the feed passage;

a plurality of control electrodes formed on a first side of the insulation base, each one of said plurality of control electrodes being formed around a corresponding one of said plurality of apertures;

a control circuit connected to the plurality of control electrodes for selectively applying a voltage to the plurality of control electrodes so as to control toner passage through the plurality of apertures; and a piezoelectric body layer having a film shape and provided on a second side of the insulation base that confronts the toner-bearing body, the piezoelectric body layer comprising pulverized piezoelectric material particles and a binder mixed with the pulverized piezoelectric material particles, at least a part of the piezoelectric body being in direct contact with the toner-bearing body carrying the toner only when at least one of the plurality of control electrodes is energized to cause the flow of toner from the toner-bearing body through one of the plurality of apertures corresponding to the at least one energized control electrode.

2. The image forming device as claimed in claim 1, wherein the piezoelectric body layer is formed to the insulation body at least at a position downstream of the plurality of apertures in the feeding direction.

3. The image forming device as claimed in claim 1, wherein the piezoelectric body layer is formed to the insulation body at positions that are upstream and downstream of the plurality of apertures in the feeding direction.

4. The image forming device as claimed in claim 3, the image forming device further comprising a plurality of lead portions formed on said first side of the insulation base, each of the plurality of lead portions being connected to a corresponding one of the plurality of control electrodes and positioned downstream in the feeding direction of the plurality of control electrodes, the piezoelectric body layer having a downstream piezoelectric body portion in a downstream direction of the feeding direction and an upstream piezoelectric body portion in an upstream direction of said feeding direction, a thickness increase at the downstream piezoelectric body layer portion being greater than that at the upstream piezoelectric body layer portion.

5. The image forming device as claimed in claim 1, wherein the piezoelectric material particles have particle diameter of 1 micronmeter.

6. The image forming device as claimed in claim 1, wherein the piezoelectric body layer has a thickness of 5 micronmeters.

7. The image forming device as claimed in claim 1, wherein the binder comprises a curable resin.

8. The image forming device as claimed in claim 7, wherein the binder comprises a liquid polyimide resin.

9. The image forming device as claimed in claim 8, wherein the piezoelectric material mass is formed of a material selected from a group consisting of barium titanate crystal, PZT and polyvinylidene fluoride.

10. The image forming device as claimed in claim 9, wherein the piezoelectric material particles are formed of the barium titanate crystal and wherein a mixing weight ratio of the barium titanate particles to the liquid polyimide resin is 1:2.

11. The image forming device of claim 1, wherein the piezoelectric material particles are sintered, wherein the piezoelectric body layer is provided by curing and polarizing the binder mixed with the pulverized piezoelectric material particles, and wherein the plurality of apertures extend through the piezoelectric body layer.

12. The image forming device of claim 1, wherein at least a part of the piezoelectric body is directly contactable with the toner-bearing body by being thickened to bring the piezoelectric body into direct contact with the toner-bearing body when at least one of the plurality of control electrodes is energized and wherein at least a part of the piezoelectric body is thinned to remove the piezoelectric body from contact with the toner-bearing body upon degenerization of the plurality of control electrodes.

* * * * *